US008272889B2

(12) United States Patent
Matoba et al.

(10) Patent No.: US 8,272,889 B2
(45) Date of Patent: Sep. 25, 2012

(54) CONNECTOR

(75) Inventors: Masato Matoba, Kawasaki (JP); Atsushi Yokoigawa, Otsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/164,147

(22) Filed: Jun. 20, 2011

(65) Prior Publication Data

US 2011/0312202 A1 Dec. 22, 2011

(30) Foreign Application Priority Data

Jun. 21, 2010 (JP) ..... 2010-140614

(51) Int. Cl.
*H01R 3/00* (2006.01)

(52) U.S. Cl. ..... 439/495; 439/67; 439/260

(58) Field of Classification Search ..... 439/630, 439/329, 67, 492, 493, 494, 495, 499, 260, 439/258, 345, 733.1, 350
See application file for complete search history.

(56) References Cited

U.S. PATENT DOCUMENTS

2005/0260885 A1* 11/2005 Lu ..... 439/495
2008/0003858 A1* 1/2008 Little et al. ..... 439/260
2009/0068860 A1* 3/2009 Suzuki et al. ..... 439/67

FOREIGN PATENT DOCUMENTS

JP 2008-277068 A 11/2008

* cited by examiner

*Primary Examiner* — Edwin A. Leon
*Assistant Examiner* — Harshad Patel
(74) *Attorney, Agent, or Firm* — Osha Liang LLP

(57) ABSTRACT

A connector has a base having an opening formed at a front surface of the base, to which a distal end of a flexible printed circuit is inserted, a plurality of insertion holes passing from the front surface to a rear surface arranged in a line at a predetermined pitch, and a fit-in recess at an upper surface of the base, a connection terminal press-fit into the insertion hole of the base from a side, a support fitting assembled to the fit-in recess of the base from an upper side, and including an elastic temporary holding portion capable of engaging a temporary holding cutout portion arranged on both side edges of the distal end of the flexible printed circuit, and an operation lever for supporting a turning shaft portion arranged at both side ends at a bearing of the support fitting in a turnable manner, and driving the connection terminal.

8 Claims, 13 Drawing Sheets

CONNECTOR

BACKGROUND OF THE INVENTION

1. Technical Field

The present invention relates to connectors, and in particular, to an ultra-small connector for connecting a flexible printed circuit (hereinafter referred to as "FPC").

2. Related Art

Conventionally, there is known a connector including a temporary holding mechanism for obtaining an inserting feeling and improving connection workability when inserting and connecting an FPC to the connector (see Japanese Unexamined Patent Publication No. 2008-277068). Thus, a predetermined inserting feeling can be obtained when the FPC is inserted into the connector, and the FPC can be temporarily held, as shown in FIG. 8, FIG. 9, and FIG. 12.

However, because an inner side beam portion 83 of a nail 81 merely moves up and down in the connector described above, it is not easy to visually determine whether the FPC is correctly positioned or not when inserted into the connector.

In particular, further miniaturization is desired for the connector in recent years, and for example, the determination on whether the FPC is positioned correctly or not is not easy and the possibility of false connection increases in a connector in which a large number of connecting portions are arranged in an outer dimension of a width dimension of 5 mm, a depth dimension of 3 mm, and a height dimension of 1 mm.

SUMMARY

In accordance with one or more embodiments of the present invention, there is provided a connector including:

a base including an opening, to which a distal end of a flexible printed circuit is inserted at a front surface, having a plurality of insertion holes passing from the front surface to a rear surface being arranged in a line at a predetermined pitch, and including a fit-in recess at an upper surface;

a connection terminal press-fit into the insertion hole of the base from the side;

a support fitting assembled to the fit-in recess of the base from an upper side, and including an elastic temporary holding portion capable of engaging a temporary holding cutout portion arranged on both side edges of the distal end of the flexible printed circuit; and an operation lever for supporting a turning shaft portion arranged at both side ends at a bearing of the support fitting in a turnable manner, and driving the connection terminal;

the connection terminal being operated by turning the operation lever to electrically connect the connection terminal to the distal end of the flexible printed circuit; wherein the elastic temporary holding portion of the support fitting elastically engaged to the temporary holding cutout portion of the flexible printed circuit is visible from the fit-in recess arranged at the upper surface of the base.

According to one or more embodiments of the present invention, the operation feeling is obtained, temporary holding can be realized, and the elastic temporary holding portion of the support fitting can be visually checked from the upper side of the base. Therefore, it can be recognized at a glance that the elastic temporary holding portion is not positioned at a predetermined position when the elastic temporary holding portion is not correctly engaged to the temporary holding cutout portion of the flexible printed circuit. Therefore, false connection can be prevented in advance and a connector of high connection reliability and connection workability can be obtained.

In one embodiment of the present invention, the support fitting may be assembled from the upper side to the fit-in recess formed on both side edges of the upper surface of the base.

According to this embodiment, the positioning of the support fitting is facilitated since the support fitting can be assembled to the fit-in recess from the upper side, whereby a connector of high assembly workability is obtained.

In another embodiment of the present invention, a press-fit tongue piece of the support fitting may be press-fit and supported in a press-fit hole formed at a bottom surface of the fit-in recess of the base, and the elastic temporary holding portion may be arranged through a coupling portion extending to the outer side from one end of the support fitting.

According to this embodiment, the elastic temporary holding portion can be turned with the press-fit tongue pieces as the center and a large displacement amount can be obtained, whereby a connector of high positioning accuracy can be obtained.

In still another embodiment of the present invention, the elastic temporary holding portion of the support fitting may have a substantially V-shape in plan view that projects toward an inner side.

According to this embodiment, the plane area of the entire elastic temporary holding portion becomes large and hence can be more easily checked visually, whereby a connector capable of more reliably preventing false connection can be obtained.

DETAILED DESCRIPTION

Figure 1A:
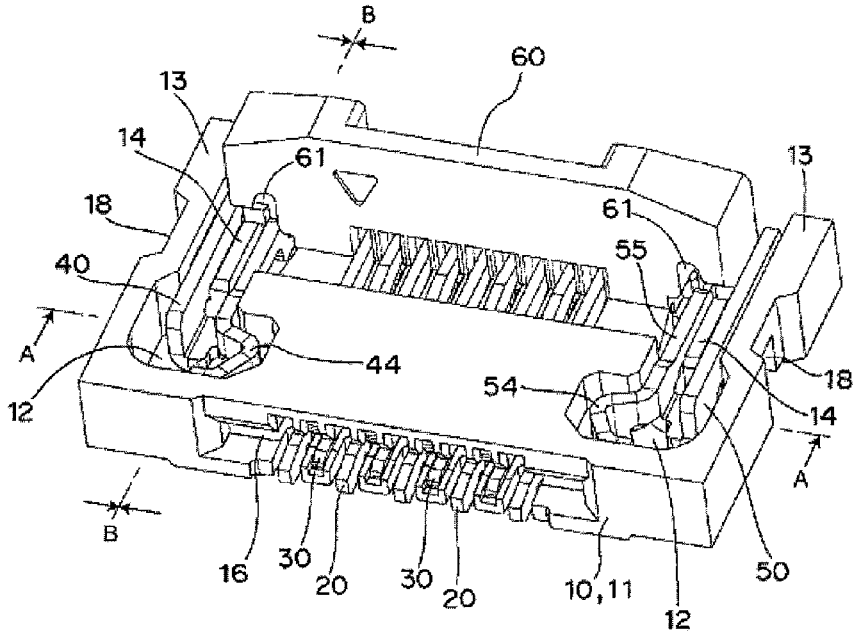
FIGS. 1A and 1B are a perspective view showing a connector according to a first embodiment of the present invention, and a cross-sectional perspective view taken along line B-B of FIG. 1A.
Figure 1B:
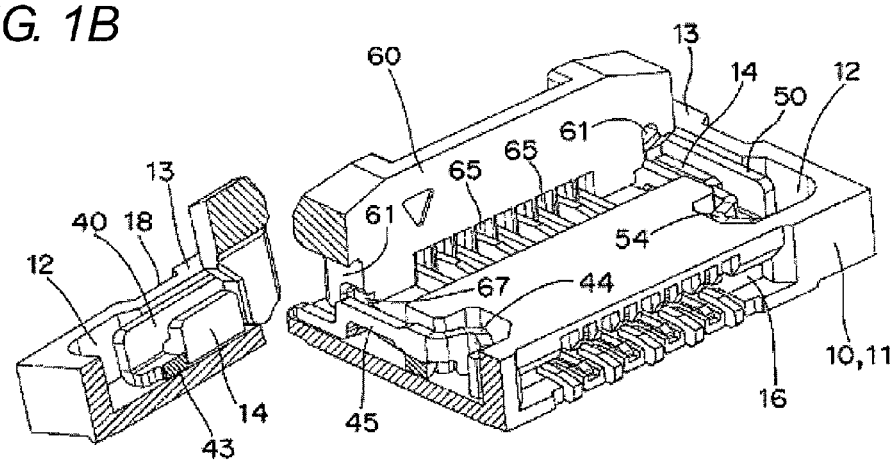
Figure 2A:
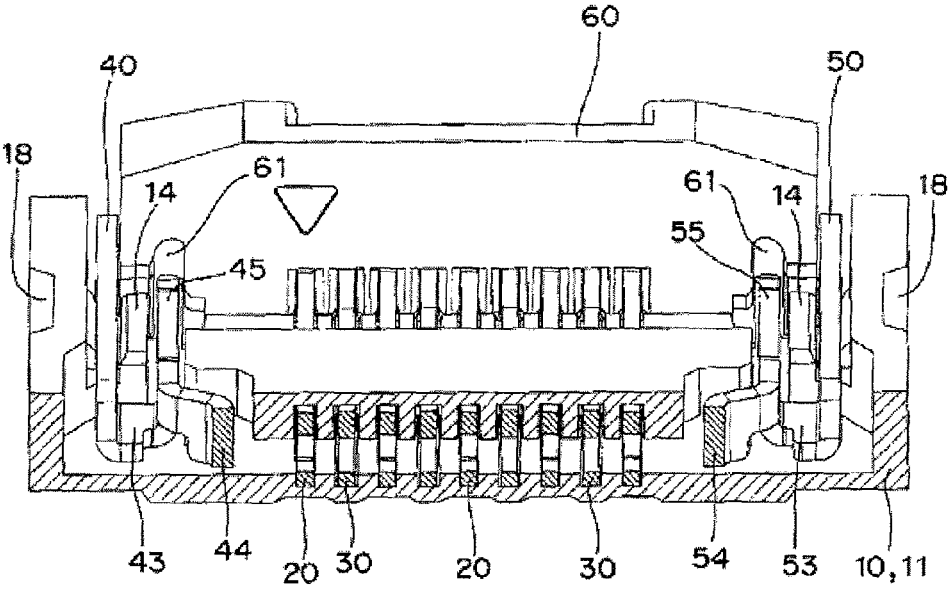
FIGS. 2A and 2B are a cross-sectional perspective view taken along line A-A of FIG. 1A, and a center longitudinal cross-sectional view.
Figure 2B:
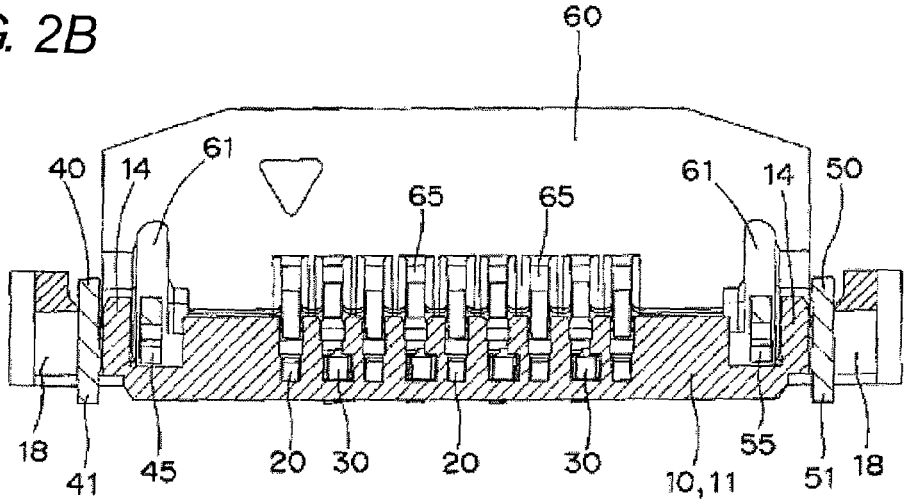

Embodiments of a connector according to the present invention will be described with reference to the accompanying drawings of FIGS. 1A to 13. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. As shown in FIGS. 1A to 11B, a connector 10 according to a first embodiment is configured mainly by a base 11, first and second connection terminals 20, 30, a pair of support fittings 40, 50, and an operation lever 60.

The outer dimension of the connector 10 according to the first embodiment has a width dimension of 4.3 mm, a depth dimension of 3 mm, and a height dimension of 0.7 mm.

Figure 5A:
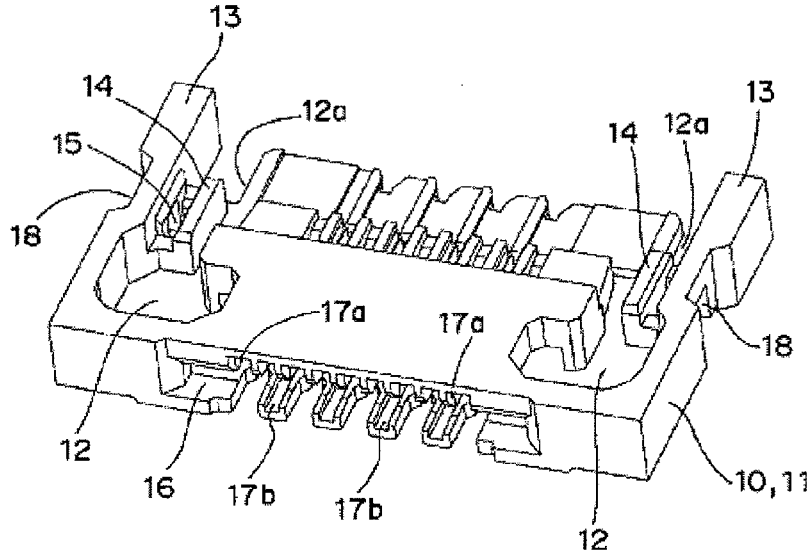
FIGS. 5A, 5B, and 5C are a perspective view, a front view, and a perspective view seen from the lower side of a base shown in FIG. 1.
Figure 5B:
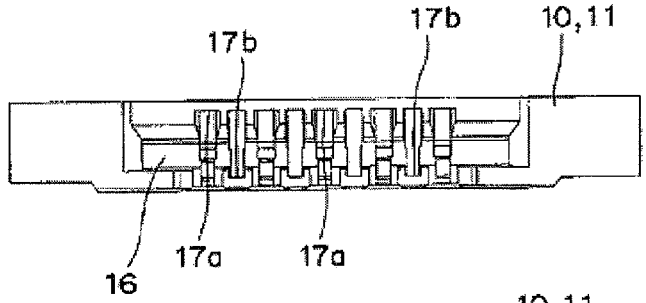
Figure 5C:
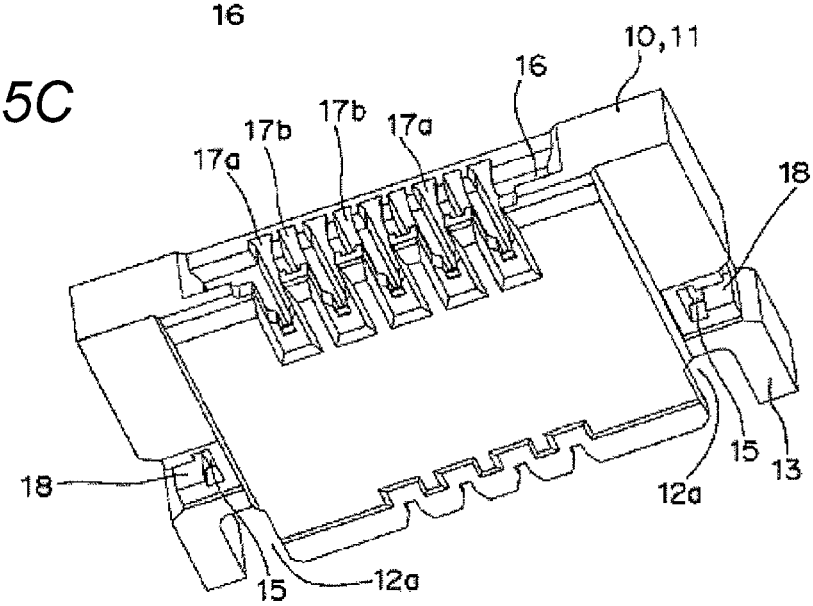
Figure 6A:
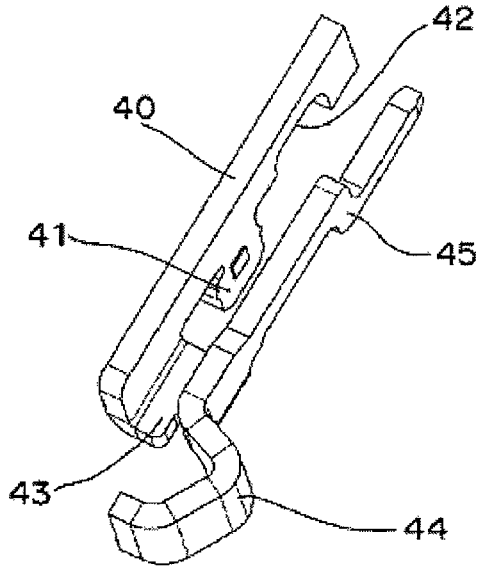
FIGS. 6A, 6B, and 6C are perspective views of the support fitting shown in FIG. 1.
Figure 6B:
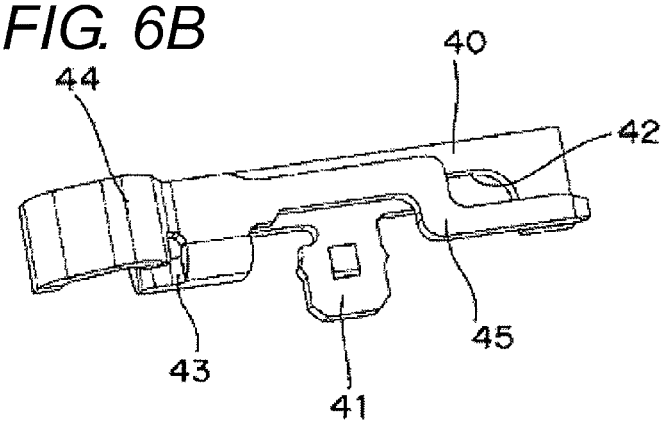
Figure 6C:
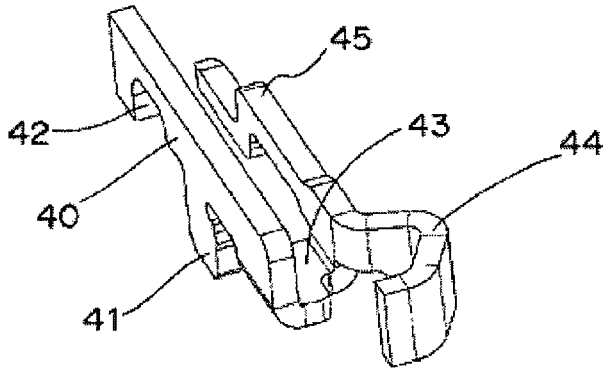

As shown in FIGS. 5A to 5C, the base 11 is formed with a side wall portion 13 by forming a fit-in recess 12 that is a position checking recess along the depth direction on both side edges of the upper surface, and is formed with a cutout 12*a* at the edge on the depth side of the fit-in recess 12. A press-fit hole 15 into which the support fittings 40, 50, to be described later, can be press-fit is formed between a partition wall 14 arranged in a projecting manner on the bottom surface of the fit-in recess 12 and the side wall portion 13. An opening 16, to which an FPC 70 can be inserted, is formed on the front surface of the base 11, and first and second insertion holes 17*a*, 17*b* that communicate to the opening 16 and pass through from the front surface to the rear surface are alternately arranged in a line. An adjustment cutout 18 is formed on the outward surface of the side wall portion 13.

As shown in FIGS. 3, 4, and FIGS. 10A to 10C, the first connection terminal 20 includes a fixed piece 21 inserted and fixed along the insertion hole 17*a* communicating to the opening 16 from the front surface side of the base 11, a coupling piece 22 arranged in a projecting manner on the upper side of the fixed piece 21, and a movable piece 23 extending substantially parallel to the fixed piece 21 on both sides from the upper end of the coupling piece 22. One end of the movable piece 23 is the movable contact portion 24 and the other end is the operation receiving portion 25. A position regulating nail portion 21*a* and a slip-put preventing projection 21*b* are arranged on the fixed piece 21.

As shown in FIGS. 3, 4, and FIGS. 10A to 10C, the second connection terminal 30 includes a fixed piece 31 inserted and fixed along the insertion hole 17*b* from the rear surface side of the base 11, a coupling piece 32 arranged in a projecting manner on the upper side of the fixed piece 31, and a movable piece 33 extending substantially parallel to the fixed piece 31 on both sides from the upper end of the coupling piece 32. One end of the movable piece 33 is the movable contact portion 34 and the other end is the operation receiving portion 35. A position regulating nail portion 31*a* and a slip-out preventing projection 31*b* are arranged on the fixed piece 31. A cam receiving portion 31*c* is arranged between the position regulating nail portion 31*a* and the slip-out preventing projection 31*b*.

As shown in FIGS. 3, 4, and FIGS. 6A to 6C, the support fitting 40 has a press-fit tongue piece 41, which is press-fit and supported at the press-fit hole 15 of the base 11, arranged in a projecting manner to the lower side at the central part of the lower side. The support fitting 40 has a bearing 42 formed on one side with the press-fit tongue piece 41 therebetween and a coupling portion 43 extending to the side from the other side. The coupling portion 43 has an elastic temporary holding portion 44 formed on one side from the distal end, and a lock long tongue piece 45 extended on the other side. Therefore, the support fitting 40 is elastically deformable with the press-fit tongue piece 41 as the center.

The support fitting 50 has a line symmetric shape with respect to the support fitting 40, and thus the numbers conforming to the support fitting 40 are denoted to the corresponding portions and the description thereof will be omitted.

Figure 7A:
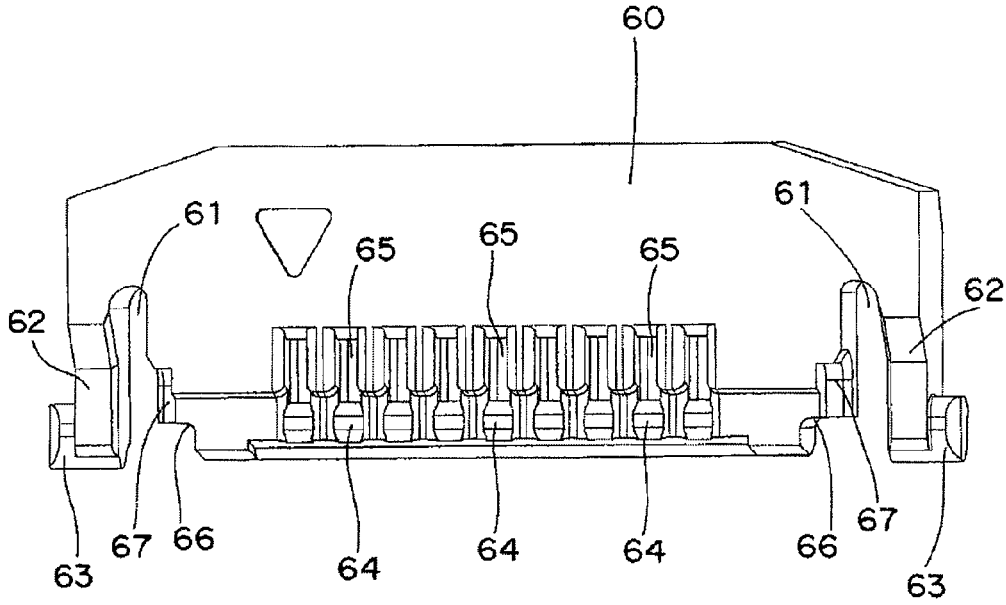
FIGS. 7A and 7B are a plan view and a bottom view of an operation lever shown in FIG. 1.
Figure 7B:
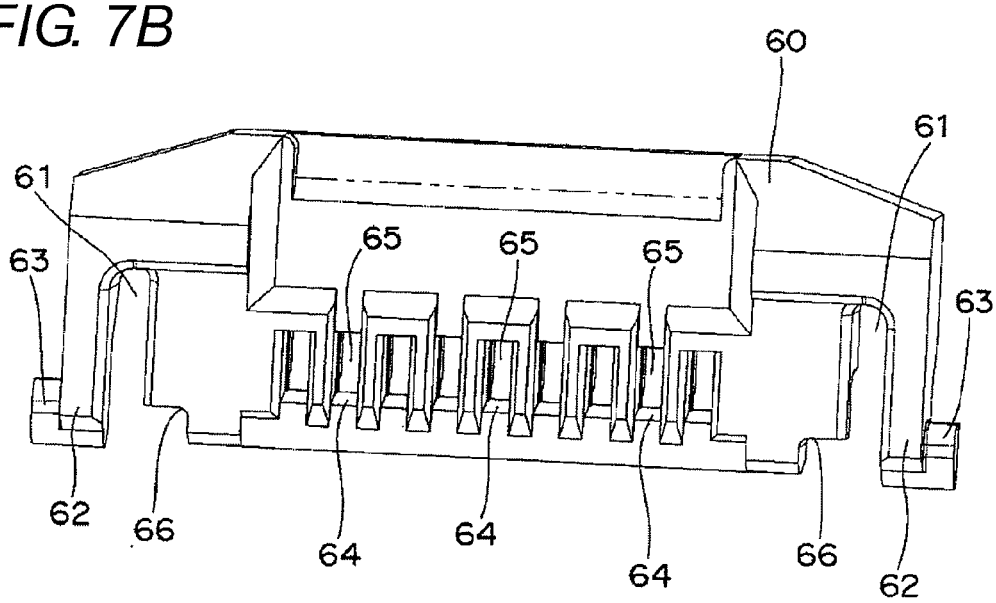

As shown in FIGS. 3, 4, and FIGS. 7A and 7B, the operation lever 60 has a slit 61 formed at the edge on both side end faces to cutout an elastic arm portion 62, where turning shaft portions 63, 63 are arranged in a projecting manner on the same axis core at the distal end of the outer side surface of the elastic arm portions 62, 62. The operation lever 60 has a cam portion 64 for operating the operation receiving portions 25, 35 of the first and second connection terminals 20, 30 arranged in a line at a predetermined pitch on one side edge, and through-holes 65, to which the operation receiving portions 25, 35 can be inserted, arranged in a line at the position corresponding to the cam portion 64. Furthermore, as shown in FIG. 7A, the operation lever 60 has a lock cutout portion 66 and a lock step portion 67 formed at the opening distal end edge of the slit 61.

Figure 8A:
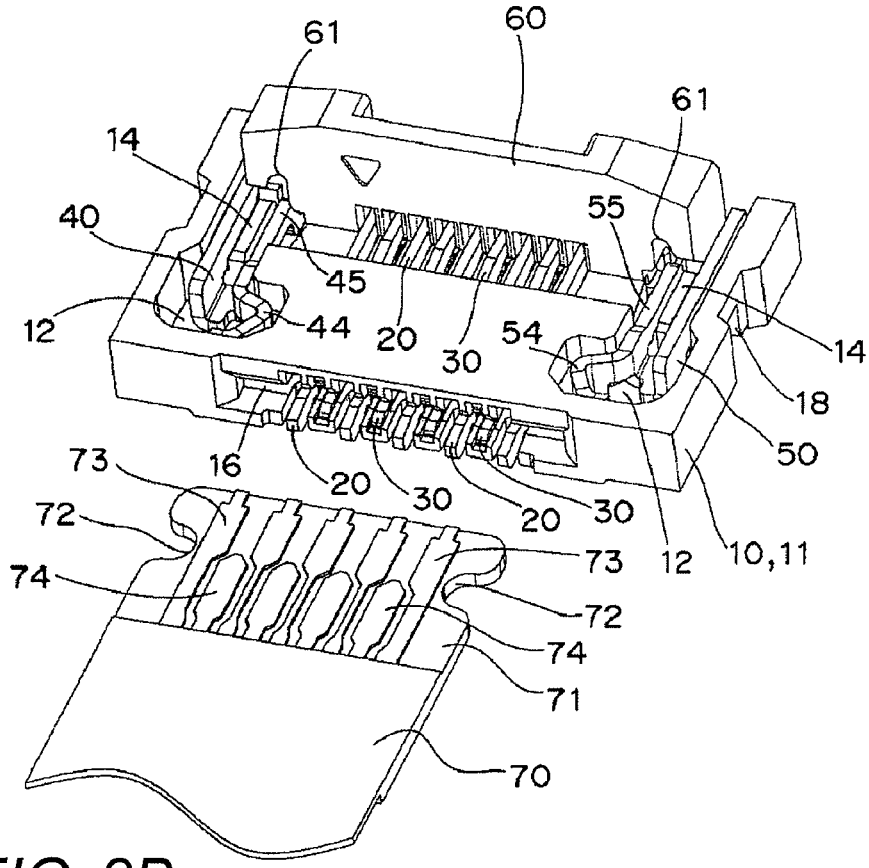
FIGS. 8A and 8B are perspective views for describing a connection method of an FPC.
Figure 8B:
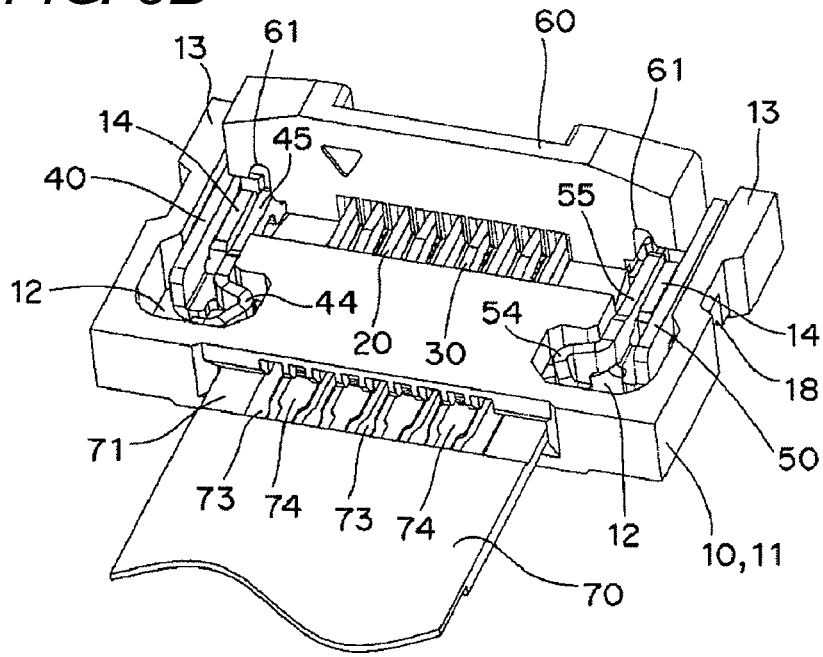

As shown in FIGS. 8A and 8B, the FPC 70 to be connected to the connector 10 according to the first embodiment has a temporary holding cutout portion 72 formed both side edges of a connecting portion 71 positioned at the distal end. The connecting portion 71 has print-wired first and second connection pads 73, 74 alternately arranged in a zigzag manner on the upper surface.

A method of assembling the connector 10 including the above-described constituent components will now be described.

Figure 3:
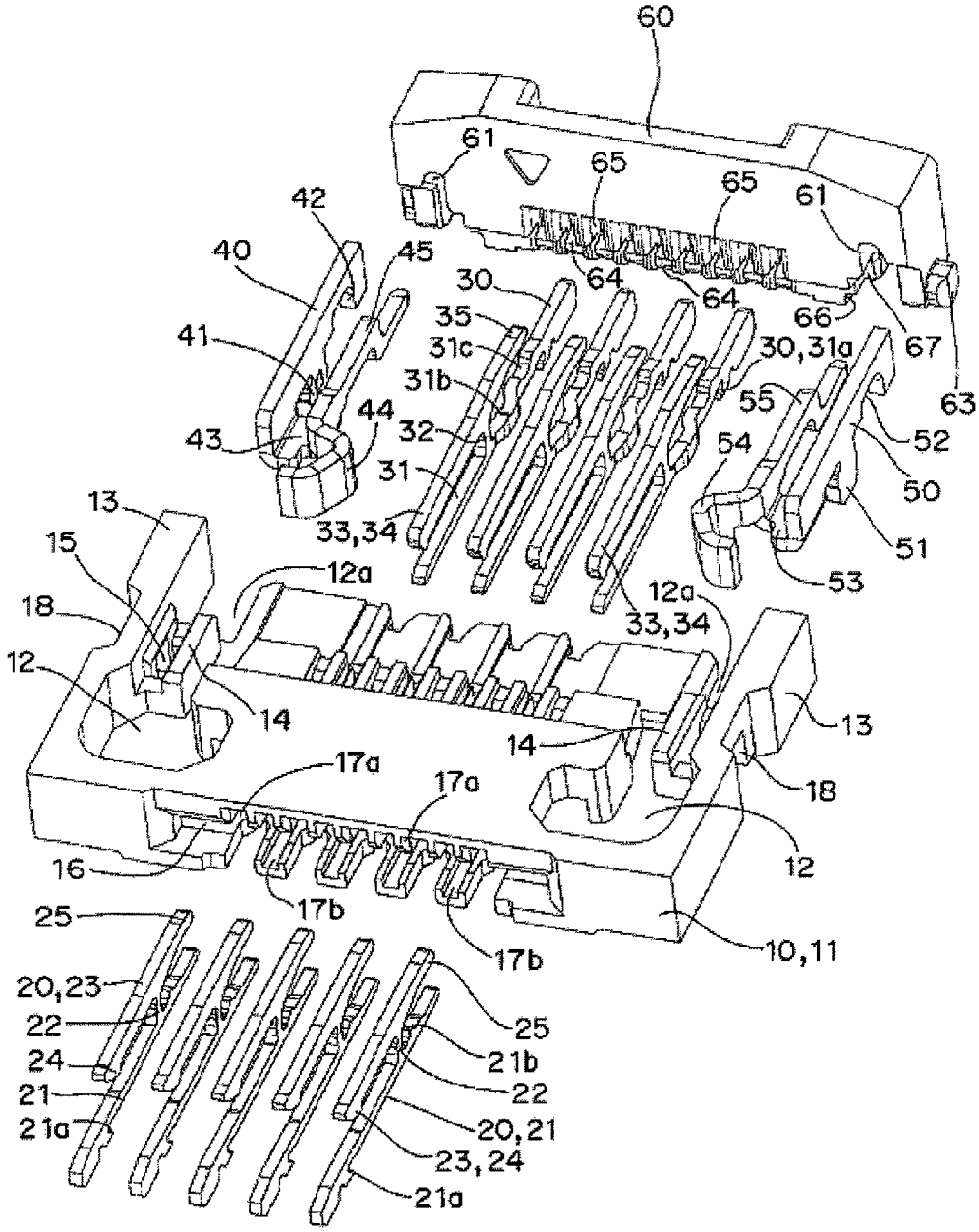
FIG. 3 is an exploded perspective view of the first embodiment shown in FIG. 1A.
Figure 4:
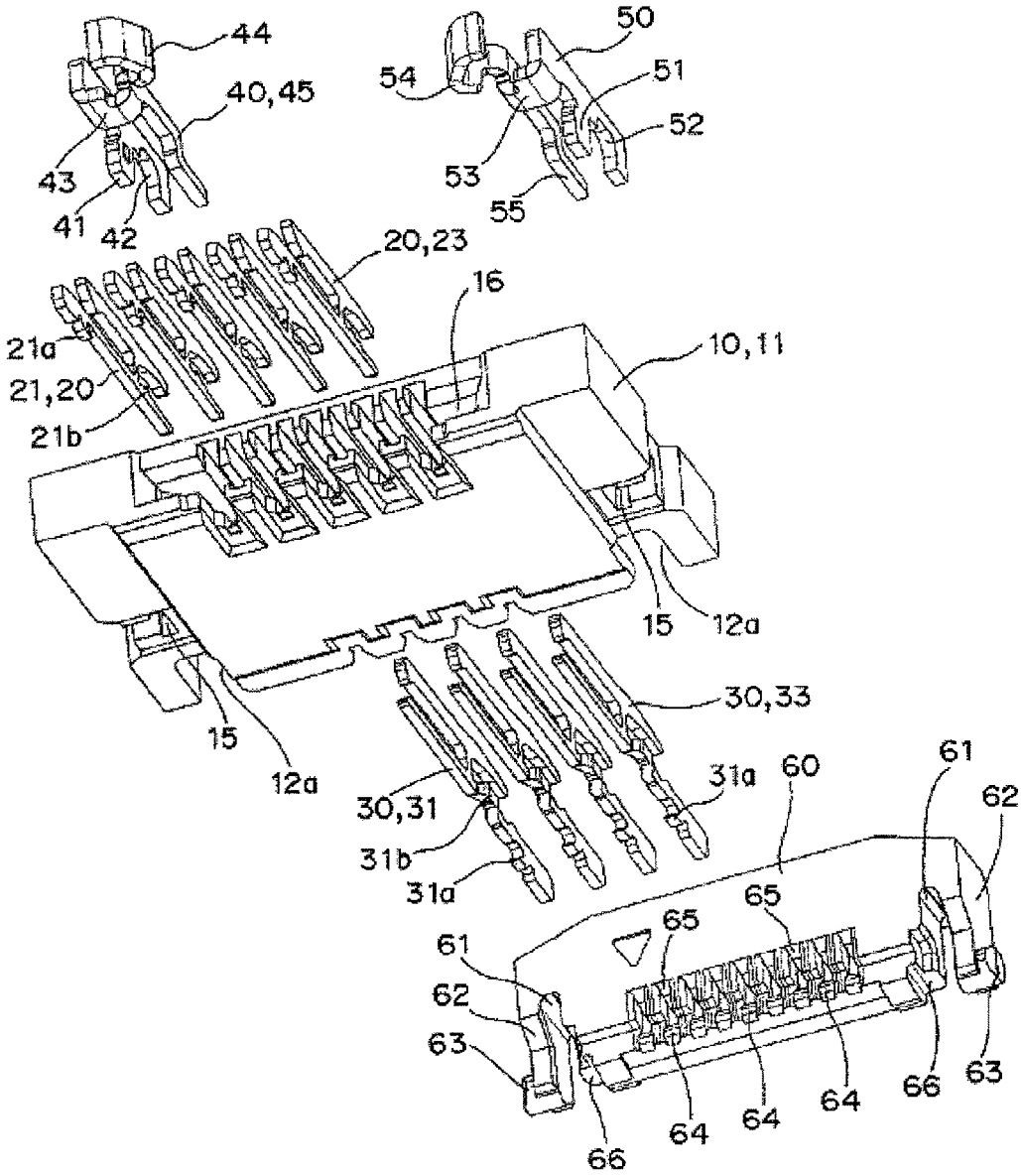
FIG. 4 is an exploded perspective view of the first embodiment shown in FIG. 1A seen from a different angle.
Figure 10A:
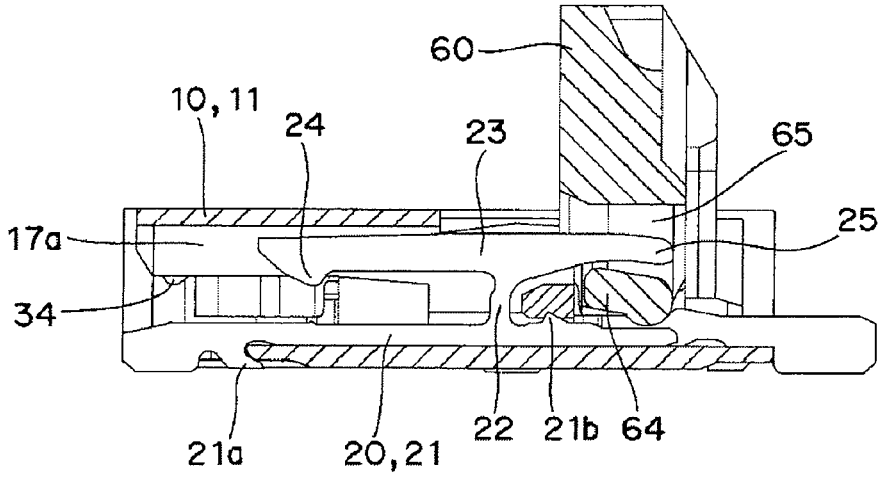
FIGS. 10A, 10B, and 10C are cross-sectional views for describing the connection method of the FPC.
Figure 10B:
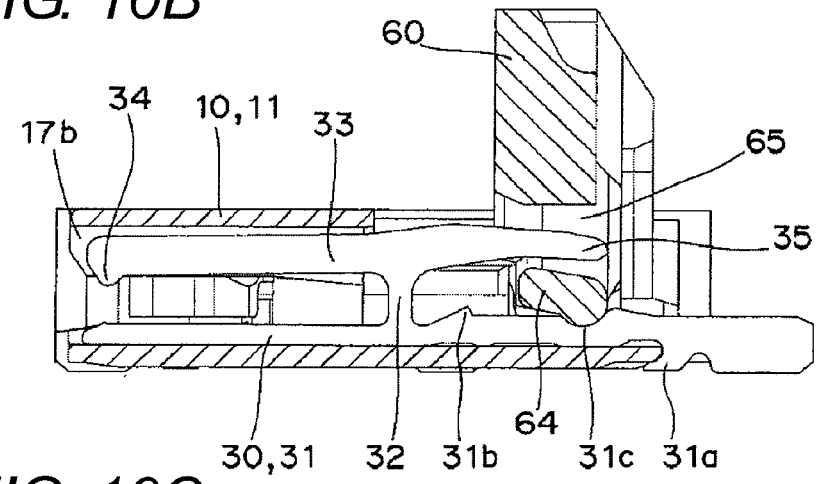
Figure 10C:
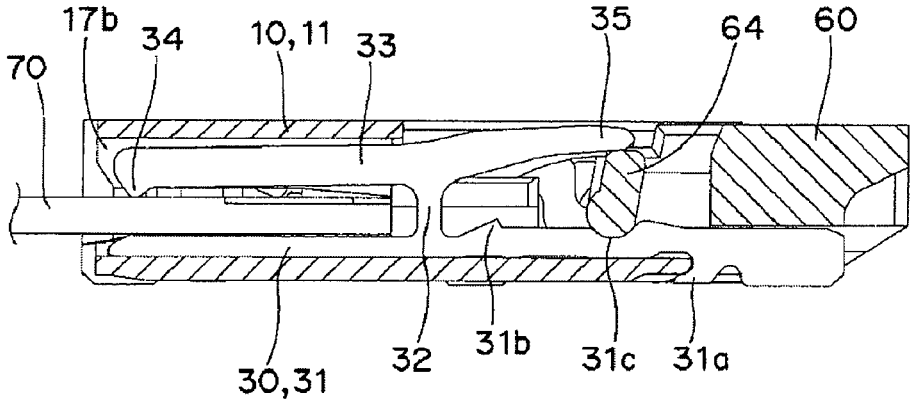

First, as shown in FIG. 3, the fixed piece 21 of the first connection terminal 20 is inserted to the first insertion hole 17*a* from the opening 16 on the front surface side of the base 11. The slip-out preventing projection 21*b* arranged on the first connection terminal 20 is thereby locked at the top surface of the base 11, and the position regulating nail portion 21*a* is locked and positioned at the opening edge of the base 11 (FIGS. 10A to 10C).

The fixed piece 31 of the second connection terminal 30 is inserted along the second insertion hole 17*b* from the rear surface side of the base 11. The slip-out preventing projection 31*b* of the second connection terminal 30 is thereby locked at the base 11, and the position regulating nail portion 31*a* is locked and positioned at the edge of the base 11.

The press-fit tongue pieces 41, 51 of the support fittings 40, 50 are then press-fit and fixed to the press-fit hole 15 formed at the fit-in recess 12 of the base 11 from the upper side, so that the elastic temporary holding portions 44, 54 and the lock long tongue pieces 45, 55 can be visually checked from the upper side.

The operation lever 60 has the turning shaft portion 63 fitted to the bearings 42, 52 of the support fittings 40, 50 through the cutout 12*a* of the base 11. Furthermore, the operation receiving portions 25, 35 of the first and second connection terminals 20, 30 are respectively inserted to the through-hole 65 of the operation lever 60, and the cam portion 64 is positioned at the cam receiving portion 31*c* of the second connection terminal 30. The operation lever 60 is thus turnably supported with respect to the base 11.

The method of connecting the FPC 70 to the connector 10 will now be described based on FIGS. 8A and 8B and FIGS. 9A and 9B.

Figure 9A:
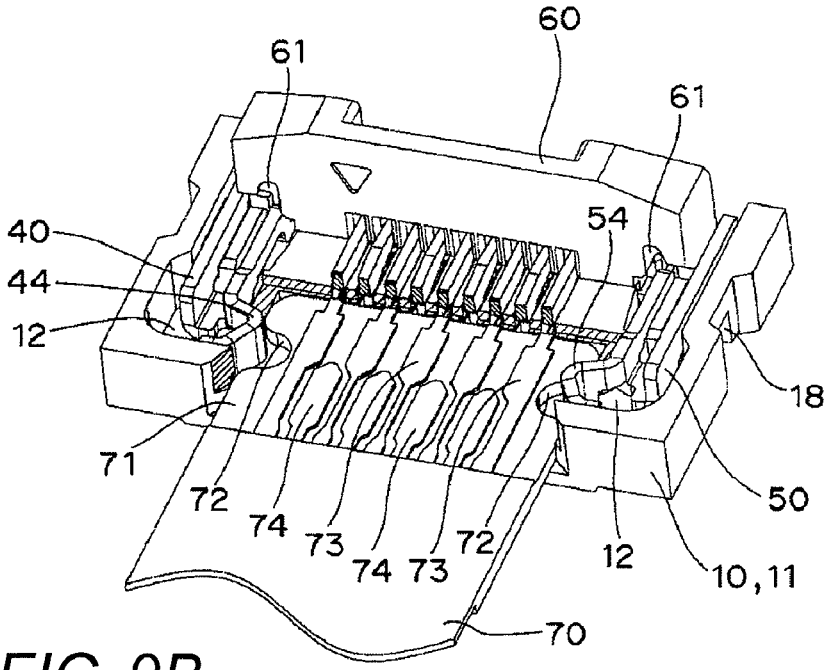
FIGS. 9A and 9B are a partially broken perspective view for describing the connection method of the FPC and a perspective view showing a state after the connection.
Figure 9B:
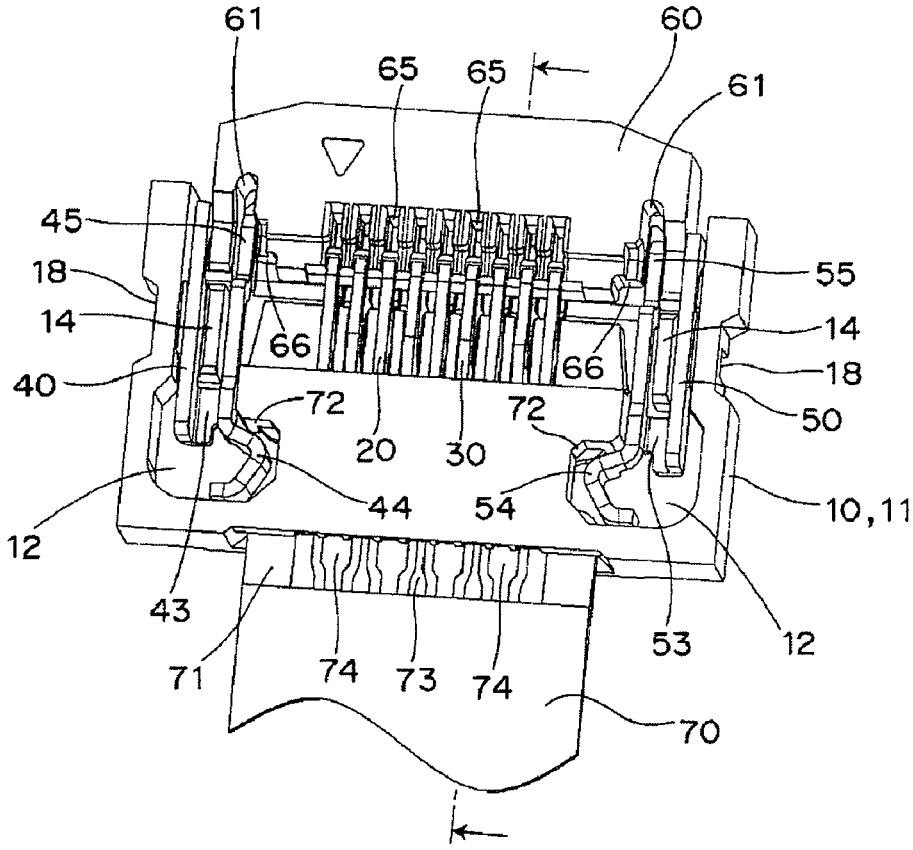

As shown in FIGS. 8A and 8B, the connecting portion 71 of the FPC 70 is inserted from the opening 16 of the base 11, and pushed to the far side of the base 11. In this case, the elastic temporary holding portions 44, 54 of the support fittings 40, 50 respectively engage the temporary holding cutout portions 72, 72 of the FPC 70, and are temporarily held after the operation feeling is obtained. Whether or not the FPC 70 is accurately positioned at a predetermined position can be checked by looking at the position of the elastic temporary holding portions 44, 54 in the fit-in recesses 12, 12 of the base 11 as shown in FIGS. 9A and 9B.

In the event of at least one of the elastic temporary holding portions 44, 54 of the support fittings 40, 50 not being engaged with the temporary holding cutout portions 72, 72 of the FPC 70, it is possible to visually check that the elastic temporary holding portion 44 or the elastic temporary holding portion 54 is not positioned at a predetermined position in the fit-in recess 12 (FIG. 9A), and false connection can be prevented beforehand.

When the operation lever 60 is turned with the axis center of the turning shaft portion 63 as the center and pushed down, the cam portion 64 simultaneously pushes up the operation receiving portions 25, 35 of the first and second connection terminals 20, 30 as shown in FIGS. 10A to 10C. Therefore, the movable pieces 23, 33 are respectively inclined with the coupling pieces 22, 32 of the first and second connection terminals 20, 30 as supporting points. As a result, the first and second movable contacts 20, 30 are respectively pressure welded and conducted to the first and second connection pads 73, 74 arranged at the connecting portion 71 of the FPC 70.

Figure 11A:
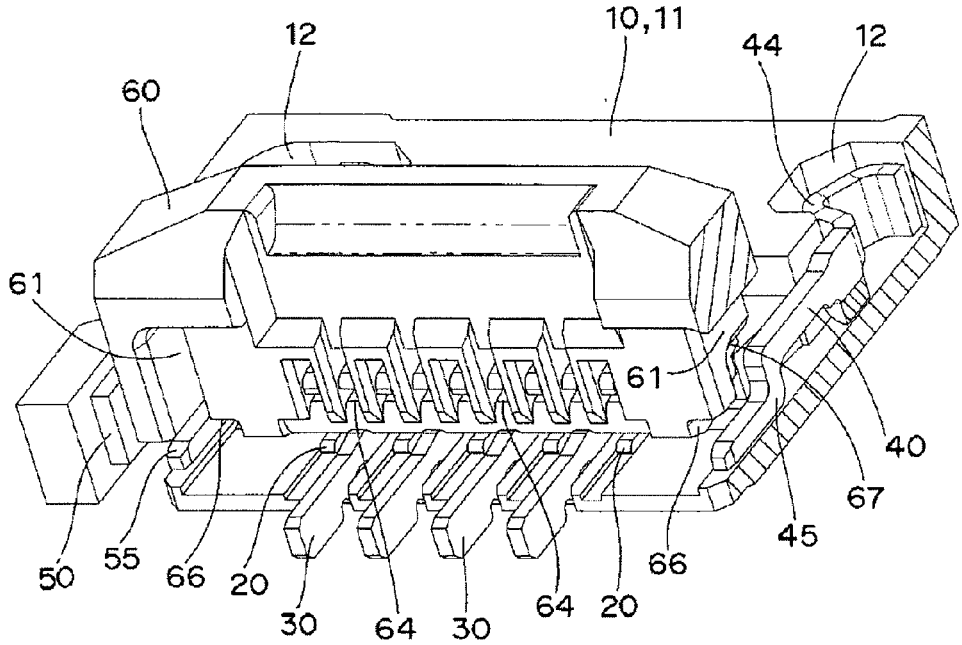
FIGS. 11A and 11B are partially broken perspective views for describing a false connection preventing structure.

Furthermore, as shown in FIG. 11A, if the operation lever 60 is turned while the elastic temporary holding portions 44, 54 of the support fittings 40, 50 are engaged with the temporary holding cutout portions 72, 72 of the FPC 70, the lock long tongue pieces 45. 55 respectively fit into the slits 61, 61 of the operation lever 60 (FIG. 9B) so that the first and second connection terminals 20, 30 can be operated with the operation lever 60.

Figure 11B:
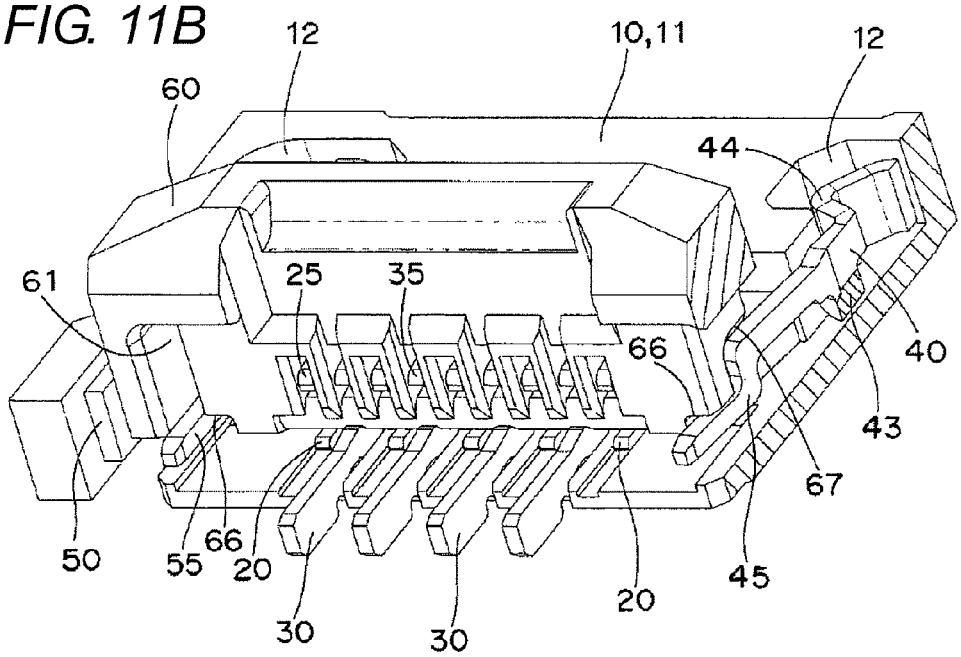

In the event of at least one of the elastic temporary holding portions 44, 54 of the support fittings 40, 50 not being engaged with the temporary holding cutout portions 72, 72 of the FPC 70, the lock long tongue piece 45 turns toward the inner side with the press-fit tongue piece 41 of the support fitting 40 as the center, as shown in FIG. 11B. Therefore, the lock long tongue piece 45 engages the lock cutout portion 66 and the step portion 67 of the operation lever 60 even if the operation lever 60 is turned, thereby inhibiting the turn of the operation lever 60 and reliably preventing false connection.

The first embodiment has an advantage in that high contact reliability can be ensured since the first and second movable contacts 24, 34 cut into the surface of the FPC 70, thereby preventing slip out.

When detaching the FPC 70 from the connector 10, the operation lever 60 is turned in the opposite direction to invert the cam portion 64, so that the bending moment of the first and second connection terminals 20, 30 with respect to the operation receiving portions 25, 35 is released. The FPC 70 is pulled after the first and second connection pads 73, 74 and the first and second movable contacts 24, 34 are separated, so that the elastic temporary holding portions 44, 54 of the support fittings 40, 50 are elastically deformed to the outer side, and then the FPC 70 is pulled out.

The lock long tongue 55 of the support fitting 40, 50 is fitted into and position regulated at the slits 61, 61 of the operation lever 60 even if a tension of forcibly pulling out the FPC 70 without turning the operation lever 60 in the opposite direction is acted, and the temporary holding cutout portions 72, 72 of the FPC 70 are brought into contact with the elastic temporary holding portions 44, 54 of the support fittings 40, 50. Therefore, the elastic temporary holding portions 44, 54 of the support fittings 40, 50 do not elastically deform with the press-fit tongue pieces 41, 51 as the center, whereby forced pull-out with respect to the FPC 70 can be inhibited, and a connector having high connection reliability can be obtained.

Figure 12A:
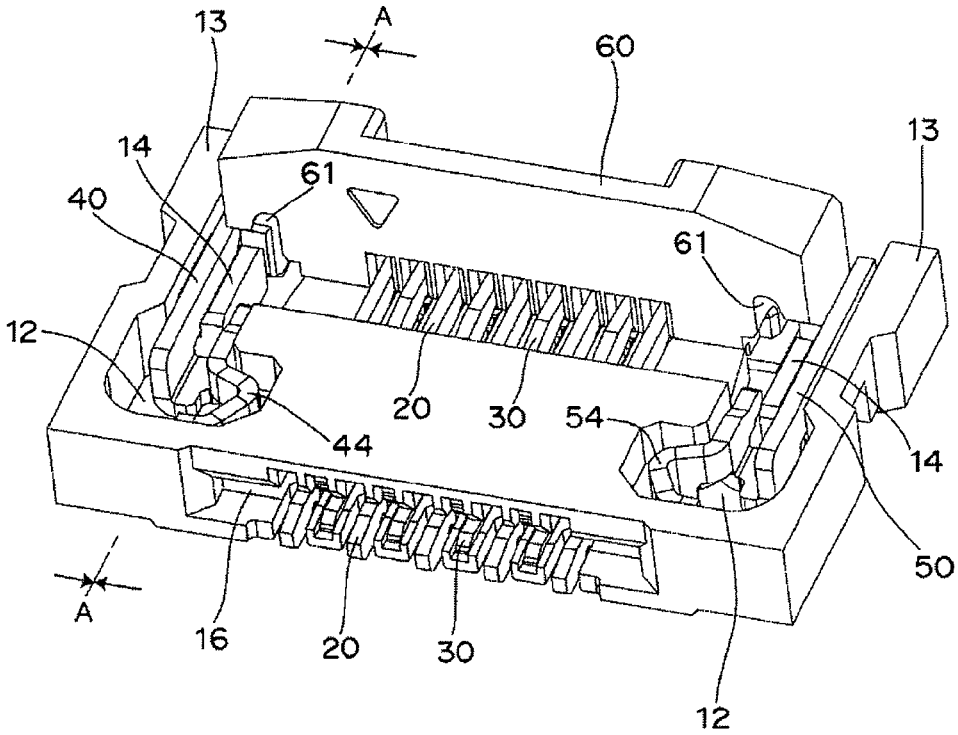
FIGS. 12A and 12B are a perspective view showing a connector according to a second embodiment of the present invention and a perspective view of a support fitting.
Figure 12B:
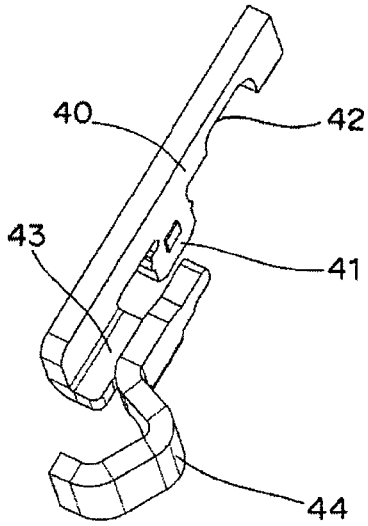
Figure 13:
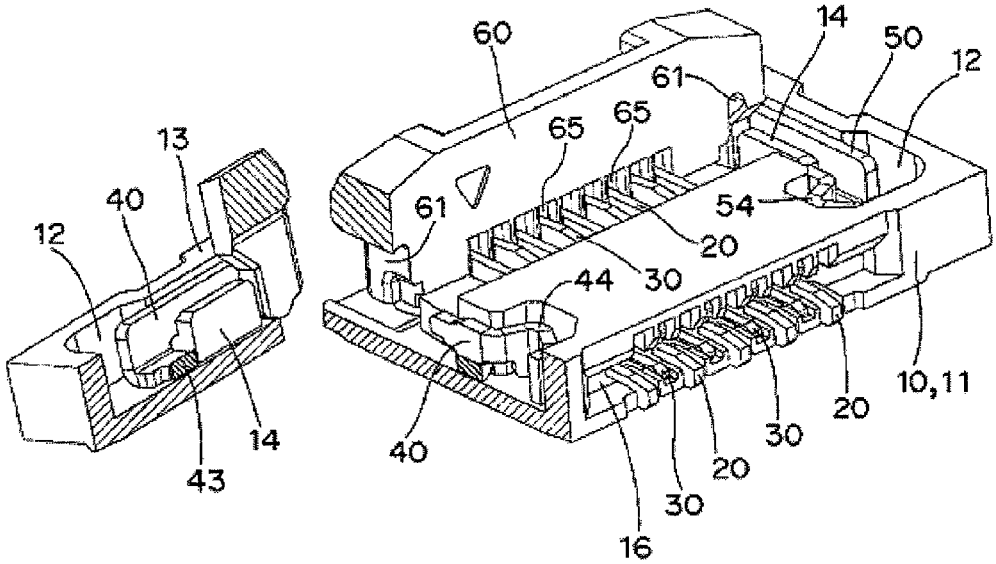
FIG. 13 is a cross-sectional perspective view taken along line A-A of the connector shown in FIG. 12A.

As shown in FIGS. 12A and 12B and FIG. 13, a second embodiment has the same basic configuration as the first embodiment, and differs in that the lock long tongue piece is not arranged in the support fittings 40, 50. The same reference numerals are thus denoted for the same portions, and the descriptions thereof will be omitted.

The connector according to the present invention is not limited to the connector of the same number as the connection terminals described above, and may be applied to a connector in which the number of connection terminals is different.

Moreover, the fit-in recess formed in the base is not limited to a planar shape as described above, and may obviously be formed in accordance with the bent shape of the elastic temporary holding portion.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector comprising:

a base comprising:

an opening formed at a front surface of the base, to which a distal end of a flexible printed circuit is inserted, a plurality of insertion holes passing from the front surface to a rear surface arranged in a line at a predetermined pitch, and a fit-in recess at an upper surface of the base;

a connection terminal press-fit into the insertion hole of the base from a side;

a support fitting assembled to the fit-in recess of the base from an upper side, and including an elastic temporary holding portion capable of engaging a temporary holding cutout portion arranged on both side edges of the distal end of the flexible printed circuit; and an operation lever for supporting a turning shaft portion arranged at both side ends at a bearing of the support fitting in a turnable manner, and driving the connection terminal, wherein the connection terminal is operated by turning the operation lever to electrically connect the connection terminal to the distal end of the flexible printed circuit, and wherein the elastic temporary holding portion of the support fitting elastically engaged to the temporary holding cutout portion of the flexible printed circuit is visible from the fit-in recess arranged at the upper surface of the base.

2. The connector according to claim 1, wherein the support fitting is assembled from the upper side to the fit-in recess formed on both side edges of the upper surface of the base.

3. The connector according to claim 2, wherein a press-fit tongue piece of the support fitting is press-fit and supported in a press-fit hole formed at a bottom surface of the fit-in recess of the base, and the elastic temporary holding portion is arranged through a coupling portion extending to the outer side from one end of the support fitting.

4. The connector according to claim 3, wherein the elastic temporary holding portion of the support fitting has a substantially V-shape in plan view that projects toward an inner side.

5. The connector according to claim 2, wherein the elastic temporary holding portion of the support fitting has a substantially V-shape in plan view that projects toward an inner side.

6. The connector according to claim 1, wherein a press-fit tongue piece of the support fitting is press-fit and supported in a press-fit hole formed at a bottom surface of the fit-in recess of the base, and the elastic temporary holding portion is arranged through a coupling portion extending to the outer side from one end of the support fitting.

7. The connector according to claim 6, wherein the elastic temporary holding portion of the support fitting has a substantially V-shape in plan view that projects toward an inner side.

8. The connector according to claim 1, wherein the elastic temporary holding portion of the support fitting has a substantially V-shape in plan view that projects toward an inner side.

* * * * *